US005356328A

United States Patent [19]

Ho

[11] Patent Number: 5,356,328

[45] Date of Patent: Oct. 18, 1994

[54] MULTI-PURPOSE YO-YO STRUCTURE

[76] Inventor: Chen-Lung Ho, Suite 1, 11F, 95-8 Chang Ping Road, Sec. 1, Taichung, Taiwan

[21] Appl. No.: 981,130

[22] Filed: Nov. 24, 1992

[51] Int. Cl.[5] ..... A63H 1/24

[52] U.S. Cl. ..... 446/242; 446/250; 446/253

[58] Field of Search ..... 446/242, 250, 251, 253, 446/254

[56] References Cited

U.S. PATENT DOCUMENTS

| | | | |
|---|---|---|---|
| 2,412,519 | 12/1946 | Kuhn | 446/250 |
| 3,162,979 | 12/1964 | Garoogian | 446/242 |
| 3,287,846 | 11/1966 | Frangos | 446/250 X |
| 4,327,518 | 5/1982 | Knauff | 446/242 |
| 4,869,699 | 9/1989 | Plambeck et al. | 446/47 |

*Primary Examiner*—Mickey Yu

[57] ABSTRACT

A multi-purpose yo-yo structure has a body constituted by two identical disk members which are mounted on a mandrel and spaced from each other to define a gap therebetween for receiving a string wound thereon. Two dome-like cover members are respectively mounted on the disk members, each having a circuit board disposed therein. A plurality of light emitting diodes are mounted on the circuit boards to be controlled thereby and cells are provided to supply electrical power to the light emitting diodes through the circuit boards. Switches which are controlled by centrifugal forces generated by the rotation of the yo-yo are respectively disposed within the cover members to turn ON/OFF the circuit boards. A speaker is also provided within the yo-yo structure for generating a funny or exciting sound when the yo-yo is rotated.

1 Claim, 8 Drawing Sheets

MULTI-PURPOSE YO-YO STRUCTURE

FIELD OF THE INVENTION

The present invention relates generally to a rotating toy structure, such as a yo-yo or a top and in particular to a toy of this type which is flashing while spinning or rotating.

BACKGROUND OF THE INVENTION

Toys, such as yo-yo and tops, are very common all over the world. These toys are generally spun or rotated with a string in playing and the fun of these toys is generally obtained from the rotation or spinning thereof. Conventionally, these toys are toys of motion, not toys of lighting and sound. It is therefore desirable to provide a flashing device on these toys so that when these toys are spinning or rotating, they are also flashing and sounding in order to increase the fun of playing.

OBJECTS OF THE INVENTION

The principal object of the present invention is to provide a multi-purpose yo-yo structure which on rotation, generates flashing and sound so as to increase the fun of playing the toy.

Another object of the present invention is to provide a rotating toy structure which comprises a flashing switch controlled by centrifugal force due to the rotation thereof.

It is also an object of the present invention to provide a rotating toy with a sounding device so that the rotation of the toy is accompanied with a funny or exciting sound.

To achieve the above-mentioned objects, there is provided a multi-purpose yo-yo structure which comprises a body constituted by two identical disk members which are mounted on a mandrel and spaced from each other to define a gap therebetween for receiving a string wound thereon. Two dome-like cover members are respectively mounted on the disk members, each having a circuit board disposed therein. A plurality of light emitting diodes are mounted on the circuit boards to be controlled thereby and cells are provided to supply electrical power to the light emitting diodes through the circuit boards. Switches which are controlled by centrifugal forces generated by the rotation of the yo-yo are respectively disposed within the cover members to turn ON/OFF the circuit boards. A speaker is also provided within the yo-yo structure for generating a funny or exciting sound when the yo-yo is rotated.

Other objects and advantages of the invention will be apparent from the following description of preferred embodiments taken in connection with the accompanying drawings wherein:

DETAILED DESCRIPTION OF THE PREFERRED EMBODIMENTS

Figure 1:
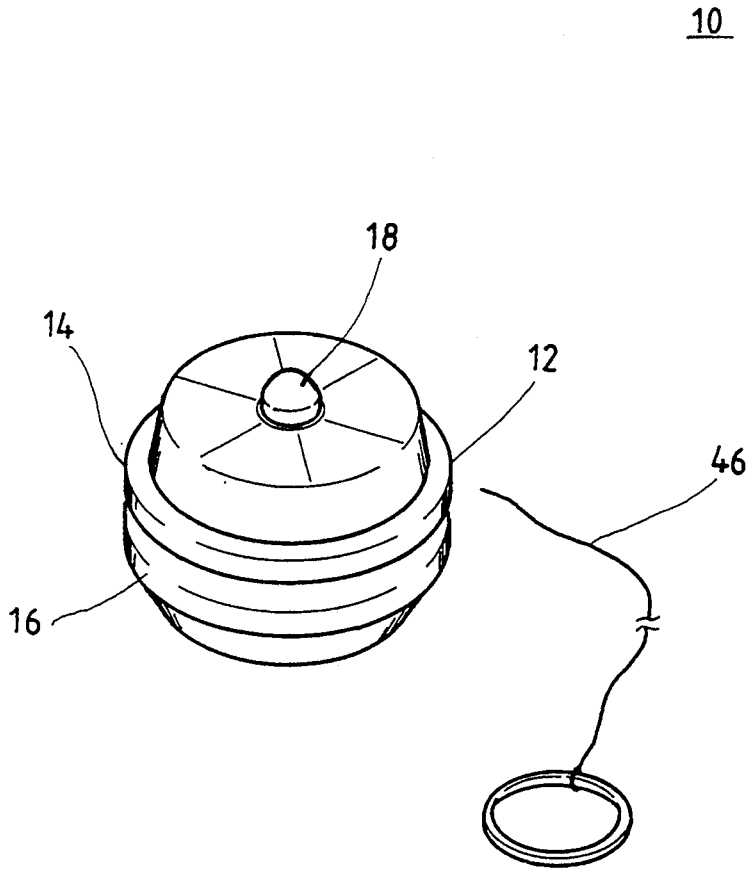
FIG. 1 is a perspective view showing a flashing rotating toy made in accordance with the present invention.
Figure 2:
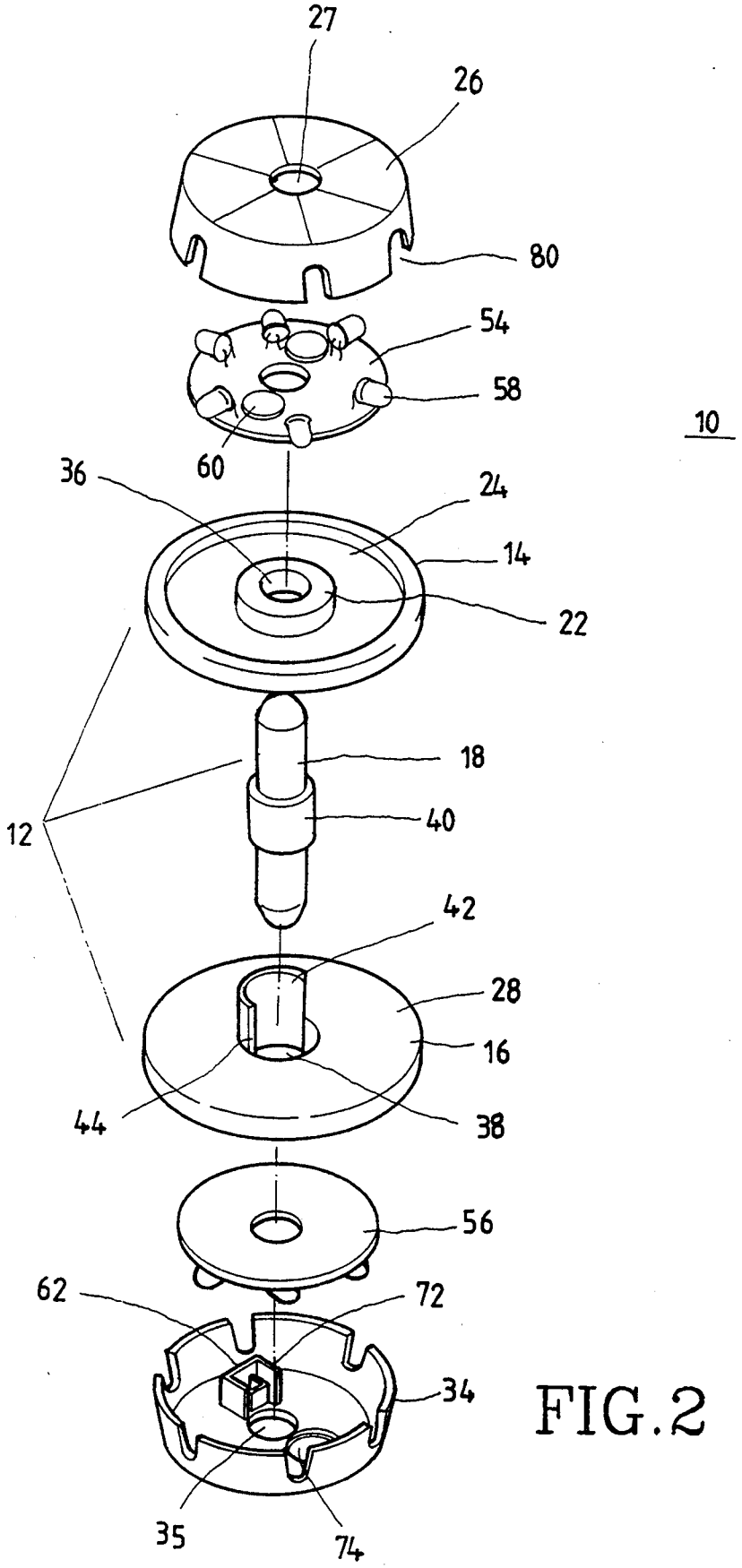
FIG. 2 is a fragmentary view of the rotating toy shown in FIG. 1.
Figure 3:
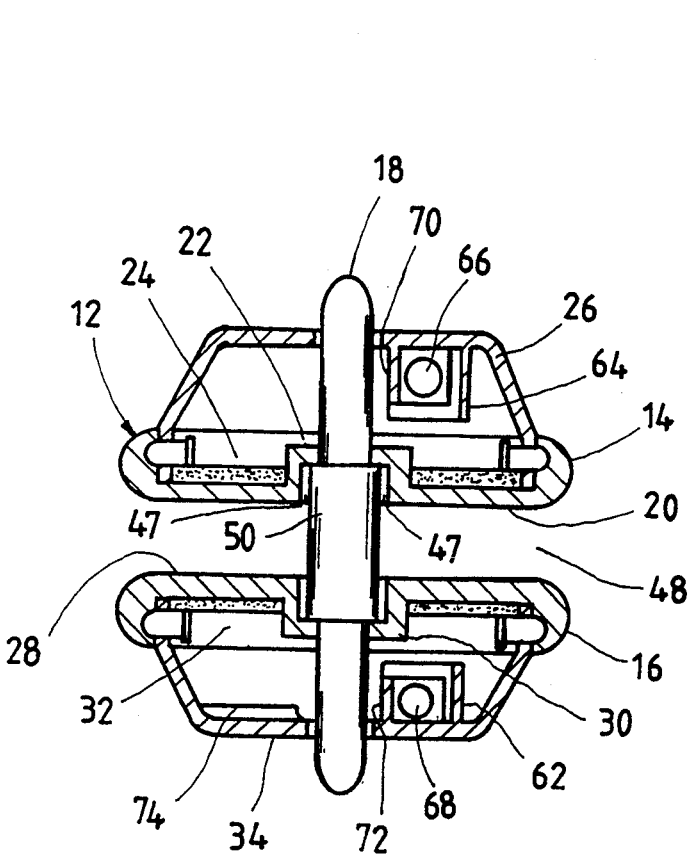
FIG. 3 is a cross-sectional view of the rotating toy shown in FIG. 1.
Figure 4:
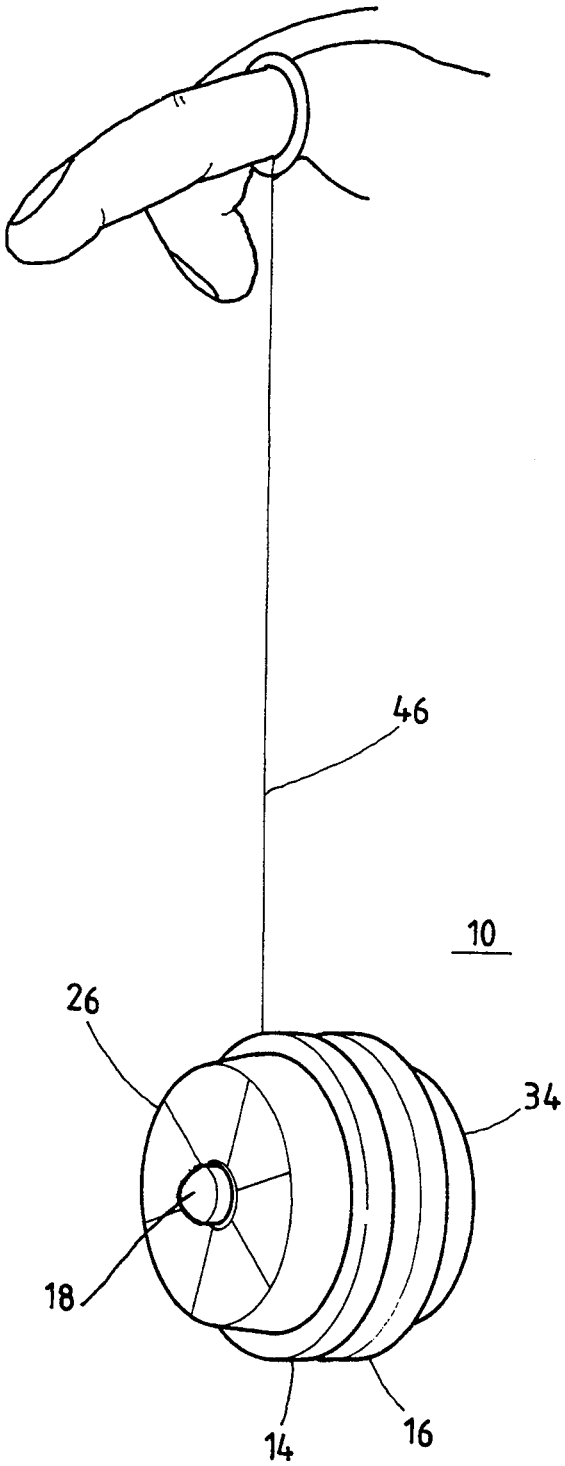
FIG. 4 is a perspective view showing the first way to play the rotating toy shown in FIG. 1.

With reference to the drawings and in particular to FIGS. 1, 2 and 3, wherein a multi-purpose yo-yo made in accordance with the present invention, generally designated with reference numeral 10 is shown, the toy 10 comprises a body 12 which is constituted by a first disk member 14 and a second disk member 16 mounted on a mandrel 18. The first and the second disk members 14 and 16 are generally identical. Therefore, it is understood that the description of the first disk member 14 is also applicable to the second disk member 16. The first disk member 14 comprises a first, inner surface 20 and a second, outer surface 22. A circumferential groove 24 is formed on the outer surface 22 of the disk member 14 to receive and hold therein a first dome-like cover member 26. Similarly, the second disk member 16 comprises a first surface 28 and a second surface 30 with a circumferential groove 32 formed on the second surface 30 to receive and hold therein a second dome-like cover member 34.

On each of the disk members 14 and 16, a central hole 36 or 38 is formed to allow the penetration of the mandrel 18 therethrough. An expanded segment 40 may be formed on the mandrel 18 at such a location to frictionally engage with the central holes 36 and 38 of the disk members 14 and 16 and thus securing the disk members 14 and 16 thereon. A semi-circular guide flange 42 is formed along a portion of the periphery of each of the central holes 36 and 38 on the first surface 20 or 28 thereof. In the drawings, only the semi-circular flange 42 formed on the second disk member 16 can be clearly observed. The semi-circular flange formed on the first disk member 14 is opposite to the semi-circular flange 42 formed on the second disk member 16 so that when the disk members 14 and 16 are assembled on the mandrel 18, the semi-circular flanges together form a cylindrical flange completely surrounding the expanded portion 40 of the mandrel 18 as shown in FIG. 3.

The dome-like cover members 26 and 34 may each be provided with a through hole 27 or 35 for allowing the mandrel 18 to partially protrude out of the cover members 26 and 34.

Figure 6:
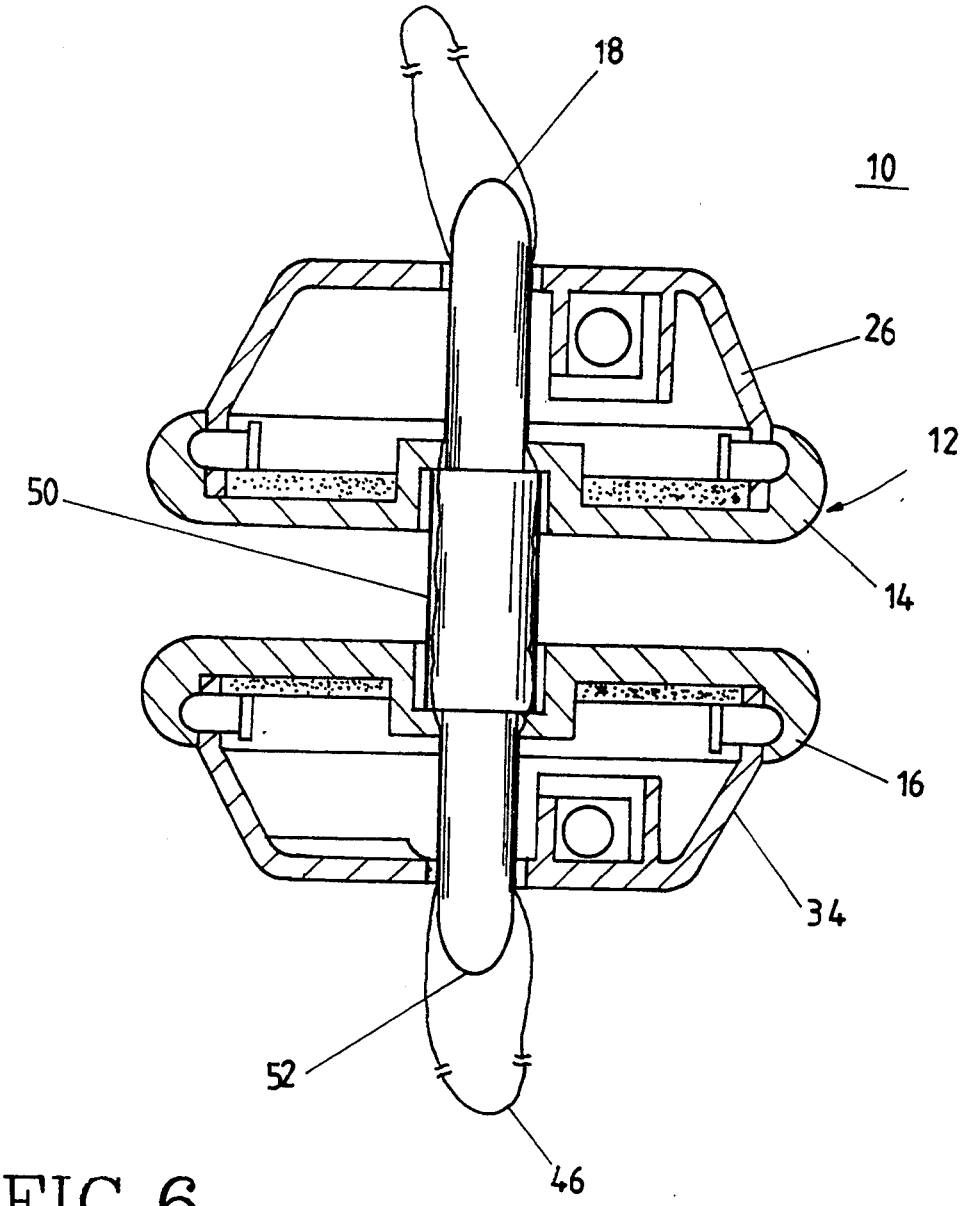
FIG. 6 is a cross-section view showing another embodiment of the present invention.

On the opposite lateral ends of each of the semi-circular flanges 42, an inclined face 44 is provided so that when the cylindrical flange around the expanded portion 40 of the mandrel is formed, two substantially triangular notches 47 are formed to allow a string 46 to pass therethrough as shown in FIG. 6 so that different ways of play the yo-yo of the present invention 10 can be embodied.

Figure 5:
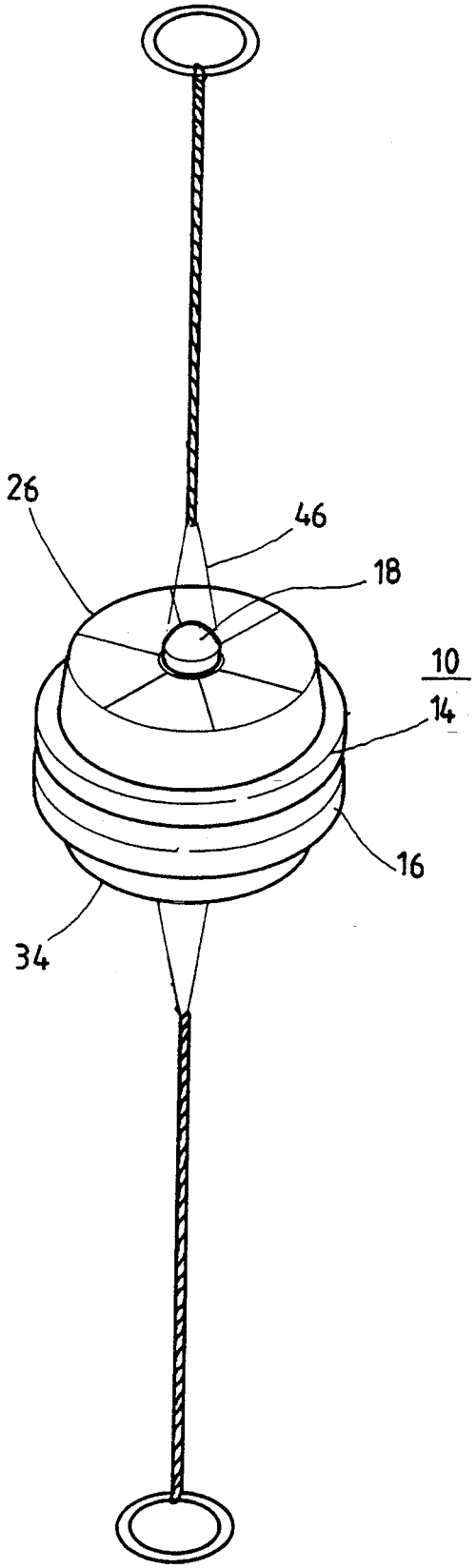
FIG. 5 is a perspective view showing the second way to play the toy shown in FIG. 1.
Figure 7:
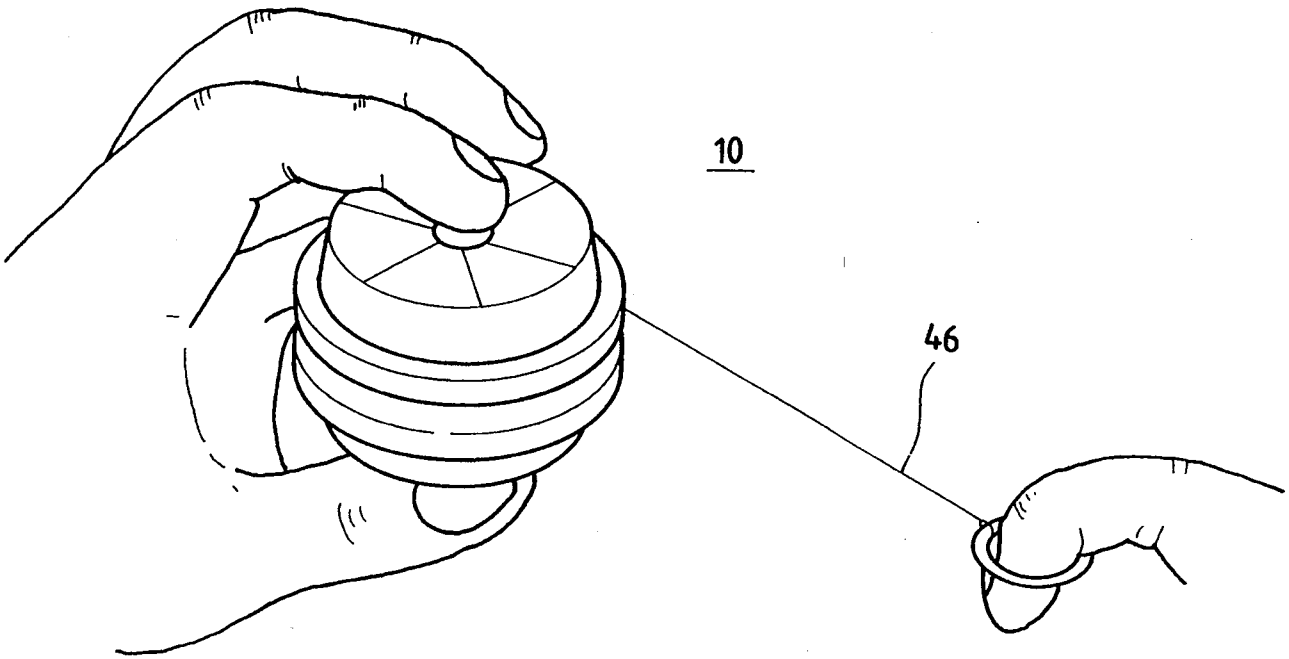
FIGS. 7 and 8 show another ways of playing the multi-purpose yo-yo in accordance with the present invention.
Figure 8:
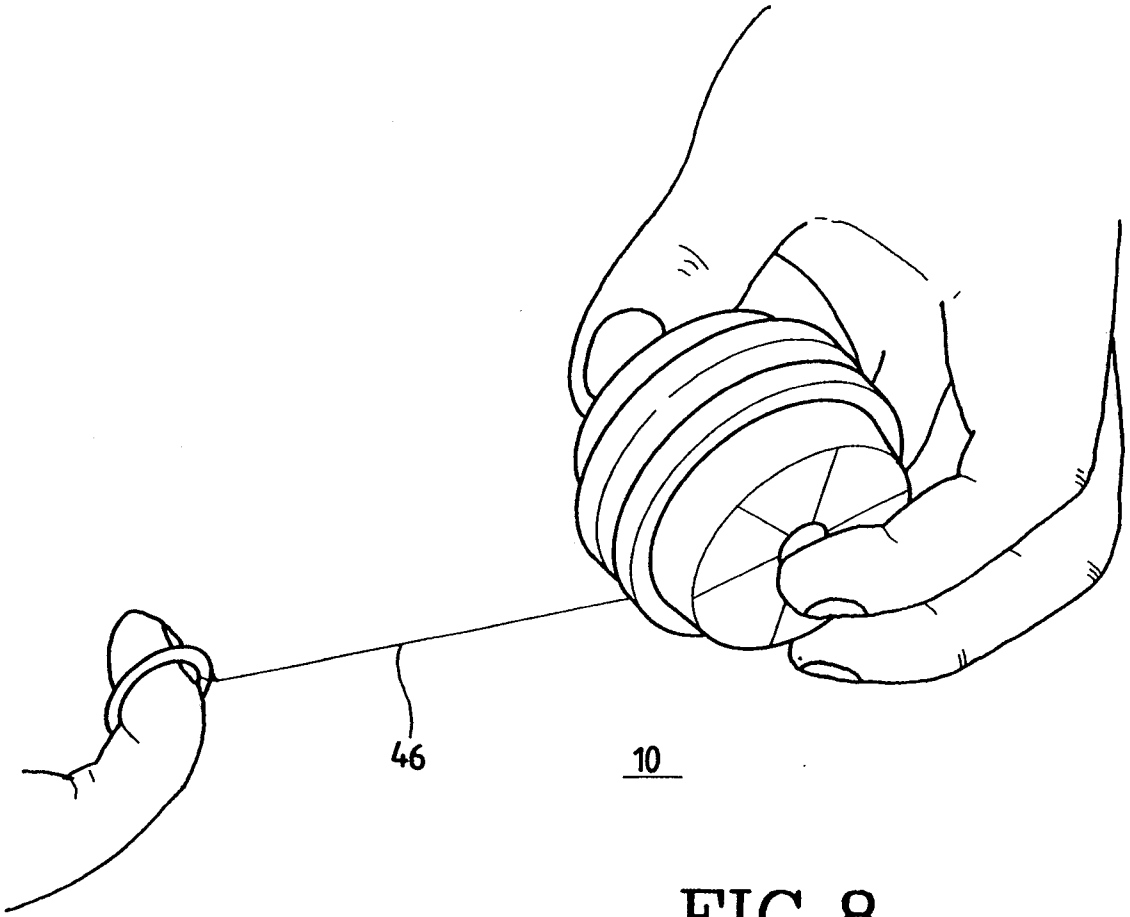

The mounting of the disk members 14 and 16 on the mandrel 18 is carried out in such a way that a gap 48 is formed between the disk members 14 and 16. The circular flange around the expanded portion 40 of the mandrel 18 defines an axle 50 for the winding of the string 46 thereon in order to play the rotating toy 10. The gap 48 defines a space for preserving therein the winding of the string 46. In this way, the boy 12 substantially constitute a yo-yo like structure which can be played as a yo-yo. If the mandrel 18 comprises a rounded end 52 as that shown in FIG. 6, the rotating toy 10 can also be played as a top. The rotating toy 10 can also be played in another way, such as the rotating disk shown in FIG. 5 and in that case, the string 46 extends through the notches 47 formed on the circular flange around the expanded portion 40 of the mandrel 18. Also FIGS. 7 and 8 show two further different ways of playing the yo-yo of the present invention.

Within each of the first cover member 26 and the second cover member 34, a circuit board 54 or 56 is disposed, on each of which, a plurality of light sources 58, such as light emitting diodes (LEDs), are mounted in electrical connection with a power source, which may be constituted by electrical cells 60 mounted on the circuit board 54 and 56 themselves or other locations within respective cover member 26 or 34. On each of the circuit boards 54 and 56, a circuit which is not clearly shown in the drawings is provided to control, for example, the sequence and flashing interval of the light emitting diodes 58. This, due to the simplicity in nature and familiarity to those having ordinary electric and electronic engineering techniques, will not be further described herein.

A centrifugal force-controlled or rotation-controlled switch 62 or 64 is formed within each of the cover members 26 and 34. Each of the switches 62 and 64 is respectively in electrical connection with one of the circuit boards 54 and 56 to control the ON/OFF state thereof. Each of the switches 62 and 64 comprises a spherical conductive member 66 or 68 (see FIG. 3) disposed within a casing 70 or 72. A pair of conductive strips (not shown) extending substantially along radii of the disk members 14 and 16 are mounted within each of the casings 70 and 72 to serve as positive and negative terminals in such a way that the positive and negative strips are approaching each other as they extend outward so that when the rotating toy 10 is rotated fast enough, the spherical members 66 and 68 roll outward within the casings 70 and 72, the spherical members 66 and 68 respectively contact the conductive strips of each of the casings 70 and 72 due to the fact that the conductive strips define a space which is gradually reduced along an outward-extending radius, establishing an electrical connection between the conductive strips and thus closing the switch 62 or 64 and actuating the LEDs 58.

In this way, once the rotating toy 10 is rotated fast enough, the switches 62 and 64 are automatically closed to light on the light emitting diodes 58 and when the rotation of the rotating toy 10 is slowed down, the switches 62 and 64 are automatically opened.

A speaker 74 may be further provided within the rotating toy 10 and is controlled by one of the circuit boards 54 and 56 to generate a sound when the switches 62 and 64 are closed.

It is understood that to show the light emitted from the light sources 58, preferably at least parts of the materials that comprise the rotating toy 10 are transparent. For example, as shown in the drawings, the light emitting diodes 58 are equally-spaced along the periphery of the circuit boards 54 and 56 and the cover members 26 and 34 comprise a plurality of openings 80 thereon corresponding to the light emitting diodes 58 to respectively partially receive therein the light emitting diodes 58. The cover members 26 and 34 may be made of a resilient material so that the flanges thereof may be deformed to be fit into the circumferential grooves 24 and 32 to be held by friction therein. The light emitting diodes 58 may be at such locations to be buried between the side walls of the grooves 24 and 32 and the cover members 26 and 34. Under this situation, at least the disk members or the cover members are transparent to allow the emitting-out of the light.

It is possible for those having ordinary skills to provide colorful patterns or figures on the surfaces of the cover members 26 and 34 in order to enhance the outlooking of the toy 10.

It is apparent that although the invention has been described in connection with preferred embodiments, those skilled in the art may make changes to certain features of the preferred embodiments without departing from the spirit and scope of the invention as defined in the appended claims.

What is claimed is:

1. A multi-purpose yo-yo structure comprising:

a body having two identical disk members, each having an inner surface and an out surface with central hole running there through, said disk members being mounted on a mandrel in such a way to define a gap between the inner surfaces thereof which face each other;

a string which is windable around an axle defined within said gap between said disk members;

two dome-like cover members respectively mounted on the outer surfaces of said disk members;

a lighting means which is disposed within spaces defined in said cover members, said lighting means comprising a plurality of light sources disposed within each said cover members and are controlled by a circuit formed within each cover members;

a switch means which is disposed within said spaces defined by said cover members to actuate said lighting means with power supplied from power sources; said switch means being electrically connected to said circuit and said power sources to control the actuation of said light sources; and each said circuit being formed on a circuit board disposed within the respective cover members and wherein said light sources are disposed along a periphery of said circuit board and are partially received within corresponding openings formed on the respective cover members.

* * * * *